United States Patent [19]

Cornell

[11] Patent Number: 4,991,318

[45] Date of Patent: Feb. 12, 1991

[54] FOOT SAFETY GUARD

[76] Inventor: Kevin S. Cornell, P.O. Box 96, Warquoit, Mass. 02536

[21] Appl. No.: 453,800

[22] Filed: Dec. 20, 1989

[51] Int. Cl.[5] ..... A43B 13/22

[52] U.S. Cl. ..... 36/72 R

[58] Field of Search ..... 36/72 R, 77 R

[56] References Cited

U.S. PATENT DOCUMENTS

| | | | |
|---|---|---|---|
| 295,877 | 3/1884 | Kennedy | 36/72 R |
| 601,529 | 3/1898 | Sharpless | 36/72 R |
| 638,484 | 12/1899 | Taylor | 36/72 R |
| 745,442 | 12/1903 | Innes | 36/72 R |
| 806,439 | 12/1905 | Smyth | 36/72 R |
| 1,440,337 | 12/1922 | Bush et al. | 36/72 R |
| 1,582,232 | 4/1926 | Vinzant | 36/72 R |
| 2,249,553 | 7/1941 | Cataffo | 36/72 R |

FOREIGN PATENT DOCUMENTS

| | | | |
|---|---|---|---|
| 18565 | of 1902 | United Kingdom | 36/72 R |

*Primary Examiner*—Paul T. Sewell
*Assistant Examiner*—BethAnne C. Cicconi
*Attorney, Agent, or Firm*—Terry M. Gernstein

[57] ABSTRACT

A foot safety guard includes a monolithic, one-piece body that is releasably attached to a wearer's shoe by a strap. The body includes a neck portion that has a break away line of weakening and a hook that engages the shoelace. The guard also includes elements that will thermally insulate the shoe from the guard and will prevent the guard from scuffing the shoe as well as elements that can be changed to provide firm footing on all surfaces.

1 Claim, 2 Drawing Sheets

FOOT SAFETY GUARD

TECHNICAL FIELD OF THE INVENTION

The present invention relates to the general art of wearing apparel, and to the particular field of shoes.

BACKGROUND OF THE INVENTION

Many workers wear safety shoes at work. This is especially true in the construction and heavy equipment industries where there is a possibility that large and heavy items may fall on a worker's foot.

The most common type of safety shoe is the steel toed work boot or steel toed work shoe in which a steel plate is embedded in the toe box section of the shoe or boot.

While such boots and shoes have been quite successful and have saved countless injuries, these items still have several drawbacks which have inhibited the full use of such safety devices.

For example, most of these foot protecting devices are not conducive to being worn outside the workplace in situations which really call for foot protection. The most common of these situations occurs when someone works at home, cutting wood, mowing a lawn, or the like. In such a situation, safety requires foot protection as much as in the workplace, but many people who would otherwise wear protective shoes at work, do not wear such "work" shoes at home. Many protective shoes are viewed as being uncomfortable for home use and are thus not worn for comfort or other such reasons.

Still further, many people opt not to wear a protective shoe outside in cold weather because the steel plate in the shoe makes the wearer's foot cold. Steel is a good conductor of heat, and thus, if the steel plate of a protective shoe is in contact with a wearer's foot, that foot will likely be uncomfortable.

Yet a further drawback associated with many work shoes is the possibility of trapping a wearer's foot in the shoe if a heavy item falls on that wearer's foot and severely deforms the steel protective plate. The collapse of the steel protective plate may trap the wearer's foot in the shoe, thereby raising a risk to the wearer.

Still further, many safety shoes, include a sole that may be non-skid on one surface, yet may skid on another surface. Such skidding may occur in a home environment, and thus discourage the wearing of the shoe at home.

Therefore, there is a need for a foot safety guard that is conducive to being worn in all situations requiring foot protection, both in the workplace and outside the workplace, yet will be comfortable in cold conditions and can be quickly removed from a wearer's foot even if the protective plate is deformed and partially collapsed and can be adapted to be non-slip in a wide variety of situations.

OBJECTS OF THE INVENTION

It is a main object of the present invention is to provide a foot safety guard that is conducive to being worn in all situations requiring foot protection, both in the workplace and outside the workplace.

It is another object of the present invention to a foot safety guard that is conducive to being worn in all situations requiring foot protection, both in the workplace and outside the workplace, yet will be comfortable in cold conditions.

It is another object of the present invention to a foot safety guard that is conducive to being worn in all situations requiring foot protection, both in the workplace and outside the workplace, yet will be comfortable in cold conditions and can be quickly removed from a wearer's foot even if the protective plate is deformed and partially collapsed.

It is another object of the present invention to a foot safety guard that is conducive to being worn in all situations requiring foot protection, both in the workplace and outside the workplace, yet will be comfortable in cold conditions and can be quickly removed from a wearer's foot even if the protective plate is deformed and partially collapsed and can be adapted to be non-slip in a wide variety of situations.

SUMMARY OF THE INVENTION

These, and other, objects are achieved by a foot safety guard which includes a monolithic, one-piece body that is releasably mounted on top of a wearer's shoe and includes thermal insulation and anti-slip elements thereon. The body includes a break away catch which attaches to the laces of the shoe or boot but which can be broken away to free the guard in the event the wearer must remove their foot from the shoe. A strap is also used to releasably mount the guard to the shoe.

Thus, the guard can be easily slipped onto whatever shoe the wearer has on and is thus conducive to being worn whenever needed, not just in the workplace where it may be required by regulations. The insulation prevents the wearer's foot from getting cold and protects the shoes from becoming scuffed.

Most importantly, however, the guard can be quickly removed in an emergency; whereas, presently available safety shoes may not be easy to remove in such emergency situations.

BRIEF DESCRIPTION OF THE DRAWING FIGURES

DETAILED DESCRIPTION OF THE PREFERRED EMBODIMENT OF THE INVENTION

Figure 1:
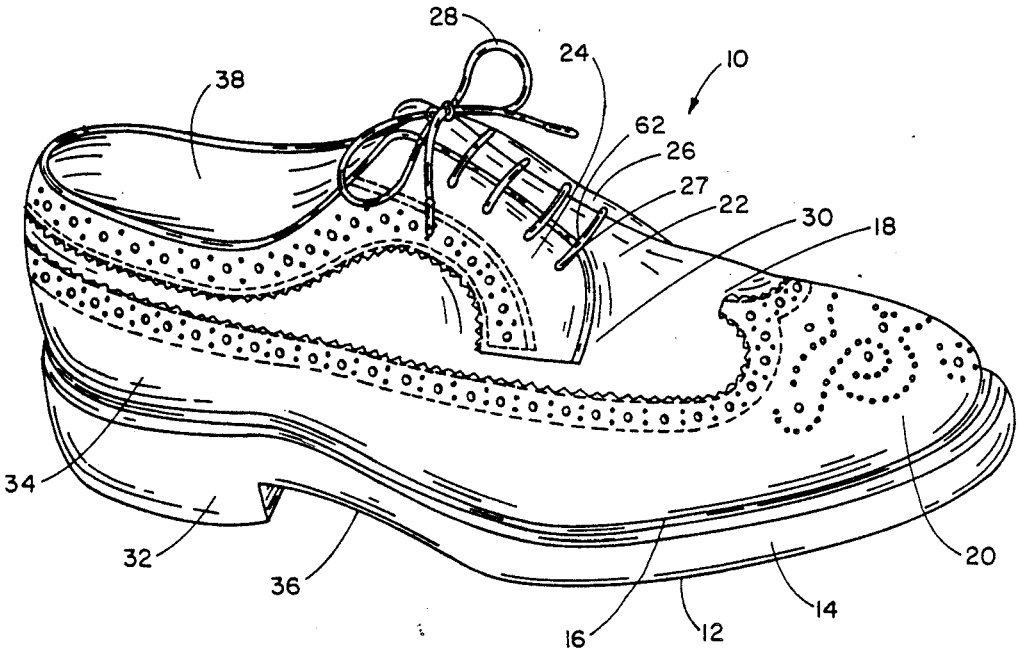
FIG. 1 is a perspective view of a shoe which can be worn in either a work environment or in a home environment in conjunction with the safety guard of the present invention.

Shown in FIG. 1 is a shoe 10 that can be comfortably worn in any situation, such as a work environment, a home environment, or the like. The shoe 10 includes a sole portion 12 that is connected by an outsole portion 14 and a welt portion 16 to vamp 18 that has a toe box 20 on a forward end and an instep 22 on the rear end. Two flaps 24 and 26 have eyelets 27 defined therein to receive lace 28 and define a throat 30 therebetween. The shoe also includes a heel 32 and a quarter section 34 that are connected to the front of the shoe by a shank section 36. A lining 38 can also be included if suitable.

Figure 2:
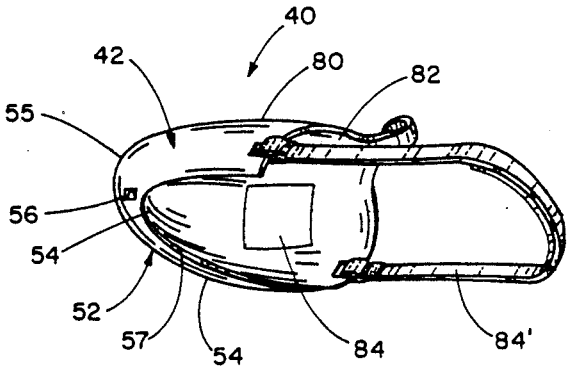
FIG. 2 is a bottom perspective view of the safety guard of the present invention.
Figure 3:
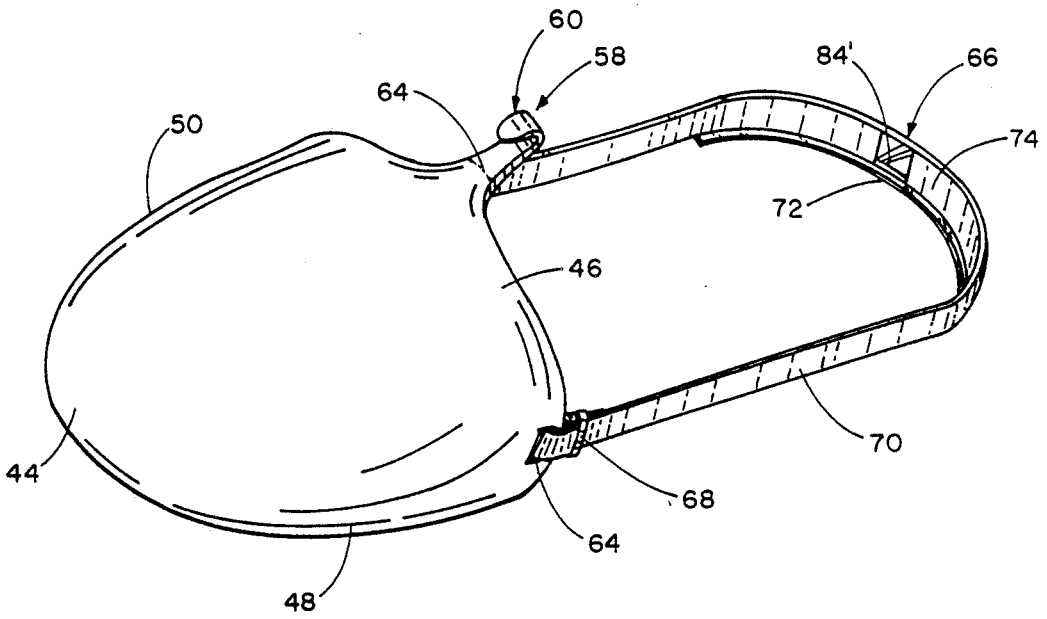
FIG. 3 is a top perspective view of the safety guard of the present invention.

The foot safety guard of the present invention is designed to fit on top of the shoe 10 in the toe box section in front of the throat section 22, and only in that section so that the guard does not become bulky and non-conducive to wear. The shoe guard 40 is best shown in FIGS. 2 and 3, and includes a monolithic, one-piece protection body 42 that has a domed shape to fit snugly over the toe box of the shoe. The monolithic, one-piece nature of the body adds strength to the body, and that body has a forward section 44 and a rear section 46 connected by side sections 48 and 50. The body is sized to fit over the toe box section of the shoe, and thus to extend in front of the throat 30, over the vamp section 18 and instep section. The body sides also fit over the outsole 14 and welt 16 that are associated with the just-mentioned forward portions of the shoe.

As shown in FIG. 2, the body includes a lip 52 that extends around the sides and front of the body and fits under the sole of the shoe near the outer peripheral edge of that shoe sole. The lip has an undersurface 54 that will contact the surface, such as a floor, on which the user is walking, and non-slip elements, such as rubber stick-on elements 56, can be removably placed on the surface 54 to add traction to the shoe. The stick-on elements can be leather, plastic or the like according to the surface on which the shoe will be used, and can be removed as necessary to be replaced by other elements in the event the shoe is used on a different surface. The lip portion 54 is preferably less than one inch in width as measured between a curved edge 55 and the innermost edge 57 of the lip. The sole of the shoe thus is only covered near the outer perimeter of the shoe. Since the sole of most shoes is designed for the most effective traction, leaving it uncovered permits the shoe to take full advantage of the basic shoe design.

The body 42 further includes a neck portion 58 having a shoelace-engaging hook 60 on one end thereof that fits around the lowermost strand 62 of the shoelace 28 to hold the body in position on the shoe. The neck portion includes a break-away line 64 that is formed of a weakened section of the metal and is used to separate the hook portion 60 from the rest of the body in the event that the body must quickly be separated from the shoe.

Two strap attaching eyelets 64 are defined in the guard and a strap 66 is attached to the guard by extending through these eyelets and being attached to two cinch fasteners, such as cinch fastener 68. The strap is monolithic and one-piece for strength purposes and has a body portion 70 having an upper edge and a lower edge, with an arcuate welt-engaging lip 72 on the lower edge thereof in a central portion 74 of the strap. The lip 72 engages the welt of the shoe to be securely held in position around the rear portion of the shoe.

The body 42 includes an outer surface 80 and an inner surface 82 which will be located adjacent to the outer surface of the shoe 10. Elements, such as element 84, are removably attached to the inner surface 82 to engage the shoe. The elements 84 are felt on the shoe engaging surface and have glue or like adhesive on the other side to mount the element on the inner surface 82. The elements also are formed of thermally insulating materials to interpose such thermally insulating materials between the plate body 42, which can be steel or other such thermal conducting material, and the shoe. The elements thus will act to prevent the wearer's foot from becoming cold due to a transfer of heat away from the foot caused by the metal plate of the body 42. The elements also act to prevent the shoe from becoming scuffed by contact with the metal plate of the body 42. The elements can cover essentially the entire inner surface 82 or only portions of that surface, and can be removed as necessary. Such elements can also be located on the strap if suitable, as indicated at 84'.

It is understood that while certain forms of the present invention have been illustrated and described herein, it is not to be limited to the specific forms or arrangements of parts described and shown.

I claim:

1. A foot safety guard comprising:

(A) a one-piece protection body having (1) a domed shape with a forward section, a rear section, side sections, a top surface and an undersurface, (2) said body extending only over a vamp section and an instep section of a shoe and around a welt section and an outsole section of a shoe associated with the vamp and instep sections, said undersurface being immediately adjacent to the shoe when said body is in position on that shoe, (3) a lip on said body, said lip surrounding only a peripheral portion of a shoe sole associated with the vamp and instep sections of the shoe covered by the body portion and being less that one inch wide as measured from said outsole with a remainder of said shoe sole being spaced from said lip and from said protection body, (4) a neck portion on said body rear section, said neck portion being shaped to correspond to a neck section of the shoe and being located in a throat section of the shoe, said neck portion including (a) a main portion which has a top surface, said neck portion top surface being an extension of said body top surface, (b) a lower surface, and (c) a shoelace hook which engages a lowermost shoelace of the shoe from beneath that lowermost shoelace when said protection body is in place on the shoe, said shoelace hook including (i) a reverse bend section attached to said neck at an end of that neck which is remote from said body rear section, said reverse bend section being spaced from said body rear section, said reverse bend section extending upwards from said neck portion above said neck portion top surface and above said body top surface, (ii) a forward section that is connected to said reverse bend section and which is spaced above said neck portion and above said body top surface and which extends towards said body rear section from said reverse bend section, said forward section having an end which is spaced from said body rear section, said forward section end being located closer to said body rear section that the lowermost shoelace of the shoe when the body is in place on that shoe, and (iii) a break away line extending across said neck portion between the shoelace hook and said protection body rear section, said neck portion being located near a midpoint of said body rear section, (5) strap attaching holes defined through each side of said body adjacent to said rear portion, said holes being elongate and extending essentially parallel with said body rear section;

(B) anti-slip elements on said lip;

(C) anti-scuff thermal insulating elements on said body undersurface in position to be interposed between said body and the outer surface of the shoe;

(D) a one-piece strap connected at first and second end sections thereof to said protective body, said strap having an upper edge, a lower edge, and an arcuate welt-engaging lip on said strap lower edge in only a central portion of said strap; and (E) first and second cinch fasteners on said first and second strap ends to hold said strap end sections against a remainder of the strap after said strap ends have been pulled through said protection body holes.

* * * * *